US007513801B2

(12) United States Patent
Cheng et al.

(10) Patent No.: US 7,513,801 B2
(45) Date of Patent: Apr. 7, 2009

(54) APPARATUS WITH DETACHABLY CONNECTED MEMORY-CARD TYPE ADAPTER

(75) Inventors: Tsung-Kan Cheng, Taipei (TW); Forli Wen, Hsinchu (TW); Tony Chang, Miaoli Hsien (TW)

(73) Assignee: C-One Technology Corporation, Hsinchu (TW)

( * ) Notice: Subject to any disclaimer, the term of this patent is extended or adjusted under 35 U.S.C. 154(b) by 710 days.

(21) Appl. No.: 10/835,351

(22) Filed: Apr. 28, 2004

(65) Prior Publication Data

US 2009/0061690 A1 Mar. 5, 2009

(51) Int. Cl.
*H01R 12/16* (2006.01)

(52) U.S. Cl. ..... 439/638; 439/946

(58) Field of Classification Search ..... 361/737; 439/638, 945, 946; 235/487, 486, 441, 492
See application file for complete search history.

(56) References Cited

U.S. PATENT DOCUMENTS 3,794,954 A * 2/1974 Reimer ..... 439/62
4,980,856 A * 12/1990 Ueno ..... 439/945
5,752,857 A * 5/1998 Knights ..... 439/638
5,822,190 A * 10/1998 Iwasaki ..... 361/737
5,877,975 A * 3/1999 Jigour et al. ..... 365/52
6,122,175 A * 9/2000 Shieh ..... 361/737
6,264,506 B1 * 7/2001 Yasufuku et al. ..... 439/638
6,413,108 B2 * 7/2002 Centofante ..... 439/267
6,438,638 B1 * 8/2002 Jones et al. ..... 710/301
6,524,137 B1 * 2/2003 Liu et al. ..... 439/638
6,671,764 B2 * 12/2003 Martin ..... 710/301
6,738,259 B2 * 5/2004 Le et al. ..... 361/737
6,761,313 B2 * 7/2004 Hsieh et al. ..... 235/451
6,808,424 B2 * 10/2004 Kaneshiro et al. ..... 439/638
2003/0201322 A1 * 10/2003 Wu ..... 235/441
2004/0087213 A1 * 5/2004 Kao ..... 439/638

* cited by examiner

*Primary Examiner*—Briggitte R Hammond
(74) *Attorney, Agent, or Firm*—Pai Patent & Trademark Law Firm; Chao-Chang David Pai

(57) ABSTRACT

An electronic apparatus is provided at one side with an adapting plate, on at least one side surface of which there is provided connecting lines, and a memory-card plug adapter is detachably connected to the apparatus through engagement of a socket provided at a front end of the adapter with the adapting plate on the apparatus. Elastic contact terminals are provided in the socket to electrically connect to the connecting lines on the adapting plate. The apparatus is adapted to plug in any type of memory-card socket provided on a computer through detachable engagement of the adapting plate on the apparatus with one memory-card plug adapter that corresponds to the memory-card socket on the computer.

7 Claims, 5 Drawing Sheets

APPARATUS WITH DETACHABLY CONNECTED MEMORY-CARD TYPE ADAPTER

FIELD OF THE INVENTION

The present invention relates to an apparatus that can be detachably connected to different types of memory-card plug connectors and can therefore be plugged in any type of memory-card socket provided on a computer via one memory-card type adapter that corresponds to the memory-card socket.

BACKGROUND OF THE INVENTION

An electronic product, such as a notebook computer, is usually provided on a main unit thereof with one or more universal serial bus (USB) sockets, to which different peripherals are electrically connected for use, and one or two memory-card sockets, in which a memory card may be plugged to allow access of data stored in the memory card.

In practical use, the memory-card sockets are not so frequently used as the USB-sockets. Therefore, there are times the USB sockets on the notebook computer are not sufficient for use while there are still unused memory-card sockets.

To fully utilize the memory-card sockets, attempts have been made to provide a memory-card socket that serves as a connecting port not only for connecting general memory cards, but also different peripherals to a computer. For this purpose, the peripheral may include a memory-card shaped plug connector. The peripheral including a memory-card shaped plug connector is referred to as a memory-card type peripheral. Examples of the memory-card type peripherals include memory-card type digital camera, memory-card type network transmission equipment, etc. By plugging the memory-card shaped plug connector in a memory-card socket on a computer, the memory-card type peripheral may be used with the computer.

However, the currently commercially available memory cards have various configurations and specifications, such as SECURE DIGITAL (SD card) 11, as shown in FIG. 1; MEMORY STICK (SD card) 12, as shown in FIG. 2; and COMPACT FLASH (CF card) 13, as shown in FIG. 3. Memory cards of different configurations require different memory-card sockets that are not compatible with one another. Since it is unknown into what type of memory-card socket a finished product of the memory-card type peripheral would be plugged, it is necessary to produce in advance a large number of peripherals with differently configured memory-card plug connector for customers' choice. For example, peripherals for the same purpose have to be produced in three categories, namely, peripherals with SD-card plug connector 21, as shown in FIG. 4, peripherals with MS-card plug connector 22, as shown in FIG. 5, and peripherals with CF-card plug connector 23, as shown in FIG. 6. This would inevitably largely increase the manufacturing cost of the memory-card type peripherals and lower the adaptability of the produced peripherals. A user has to pay more money to buy memory-card type peripherals with different memory-card shaped plug connectors to work with different types of memory-card sockets on the computer.

SUMMARY OF THE INVENTION

A primary object of the present invention is to provide an apparatus with detachably connected memory-card plug adapter to reduce the cost for manufacturing the memory-card type peripherals, and to enable more convenient use of the memory-card type peripherals.

To achieve the above and other objects, the present invention includes an electronic apparatus being provided at one side with an adapting plate, on at least one side surface of which there is provided with connecting lines, and a memory-card plug adapter detachably connected to the apparatus through engagement of a socket provided at a front end of the adapter with the adapting plate on the apparatus. Elastic contact terminals are provided in the socket to electrically connect to the connecting lines on the adapting plate when the latter is inserted into the socket. The apparatus is adapted to plug in any type of memory-card socket provided on a computer through engagement of the adapting plate on the apparatus with one memory-card plug adapter that corresponds to the memory-card socket on the computer.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
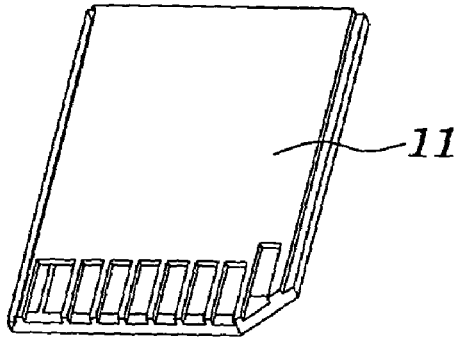
FIG. 1 is a perspective view of an SD card.
Figure 2:
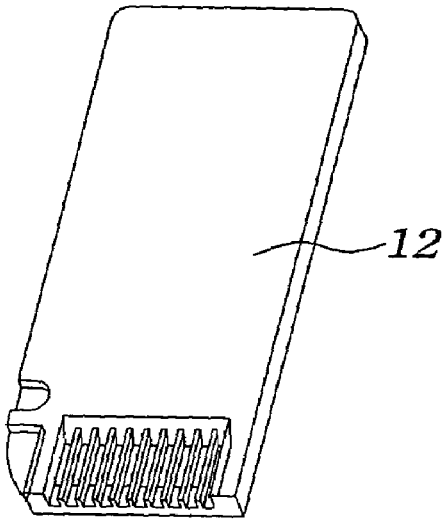
FIG. 2 is a perspective view of an MS card.
Figure 3:
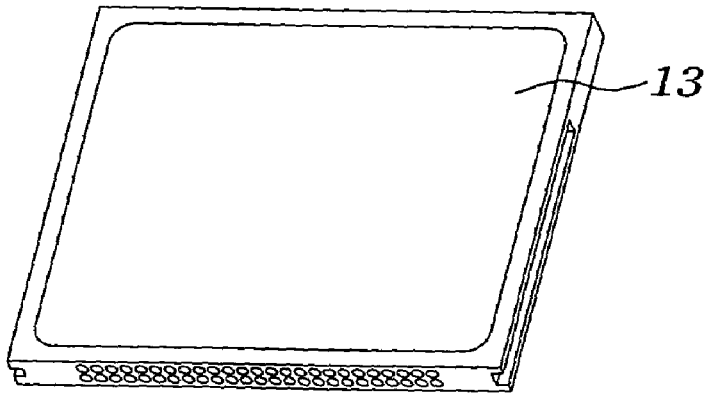
FIG. 3 is a perspective view of a CF card.
Figure 4:
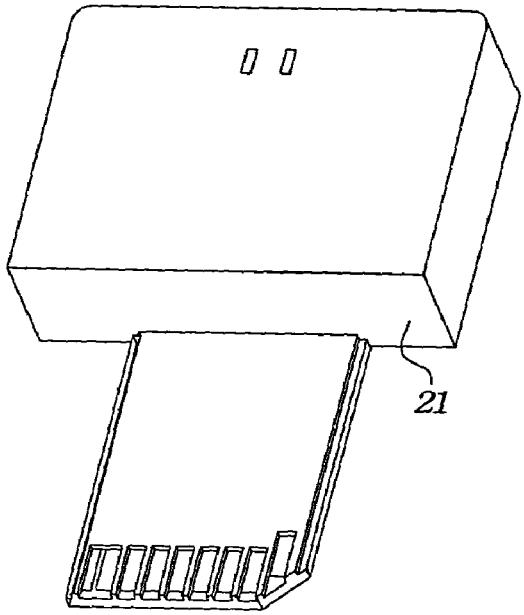
FIG. 4 schematically shows a general peripheral with an SD-card plug adapter.
Figure 5:
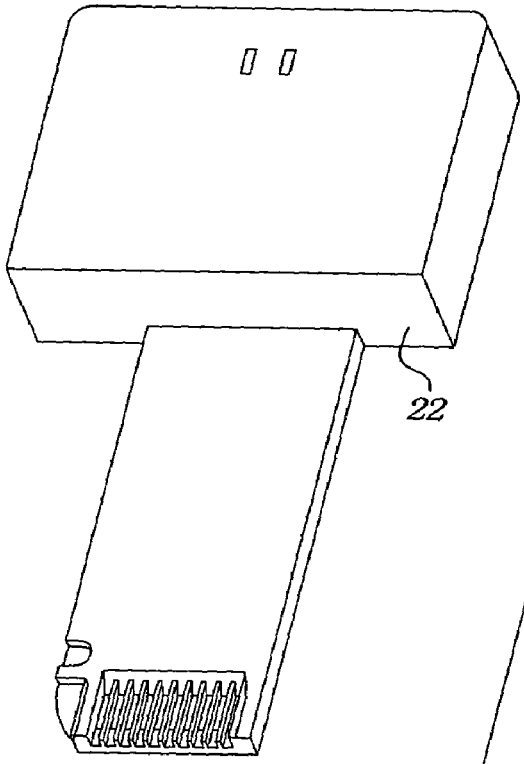
FIG. 5 schematically shows a general peripheral with an MS-card plug adapter.
Figure 6:
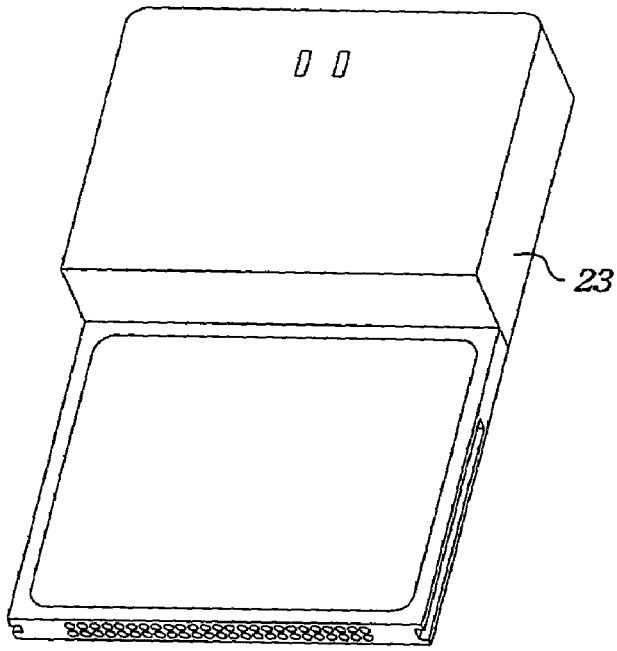
FIG. 6 schematically shows a general peripheral with a CF-card plug adapter.
Figure 7:
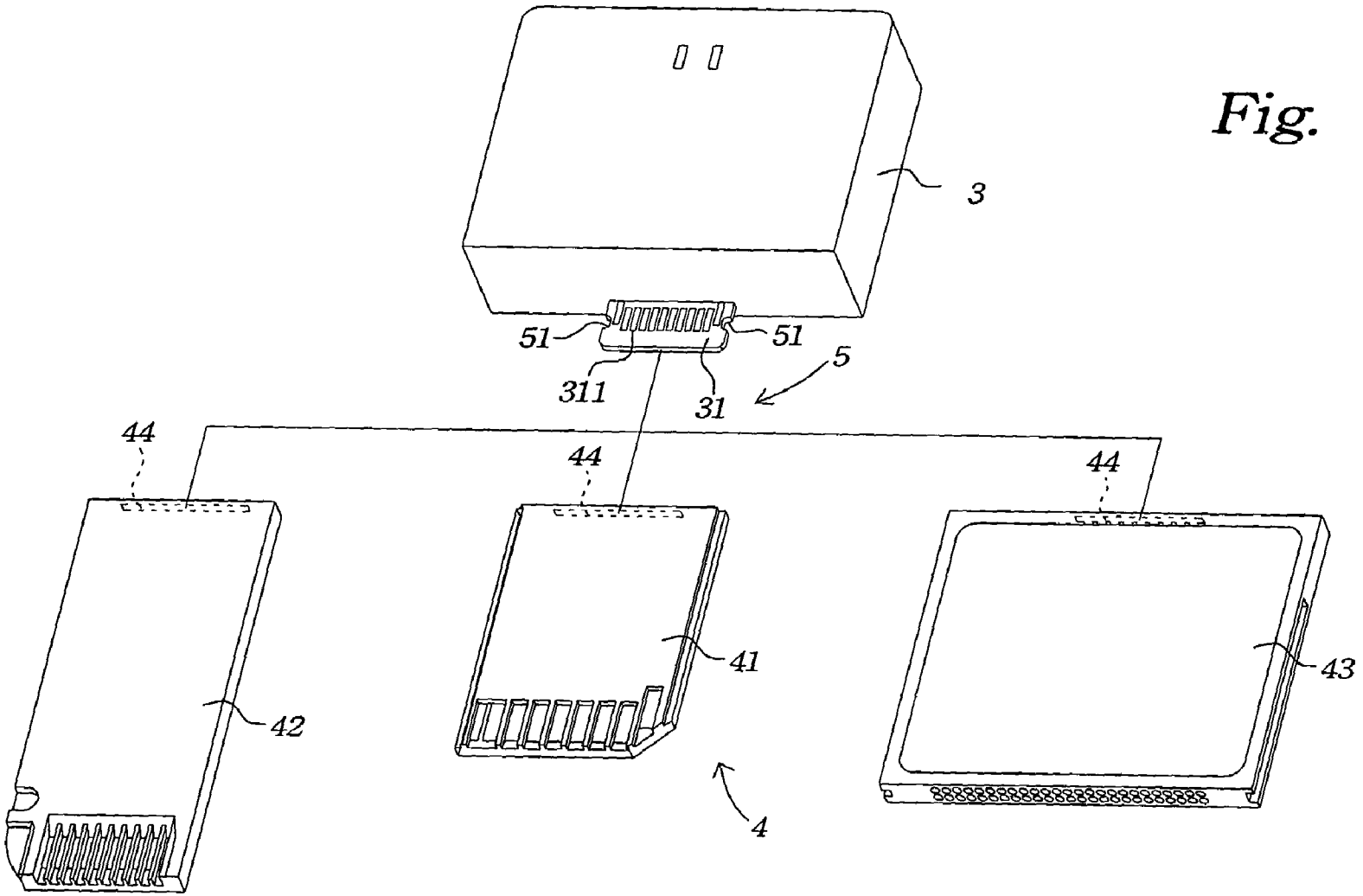
FIG. 7 is an exploded top perspective view of an apparatus with detachably connected memory-card plug adapter according to the present invention.
Figure 8:
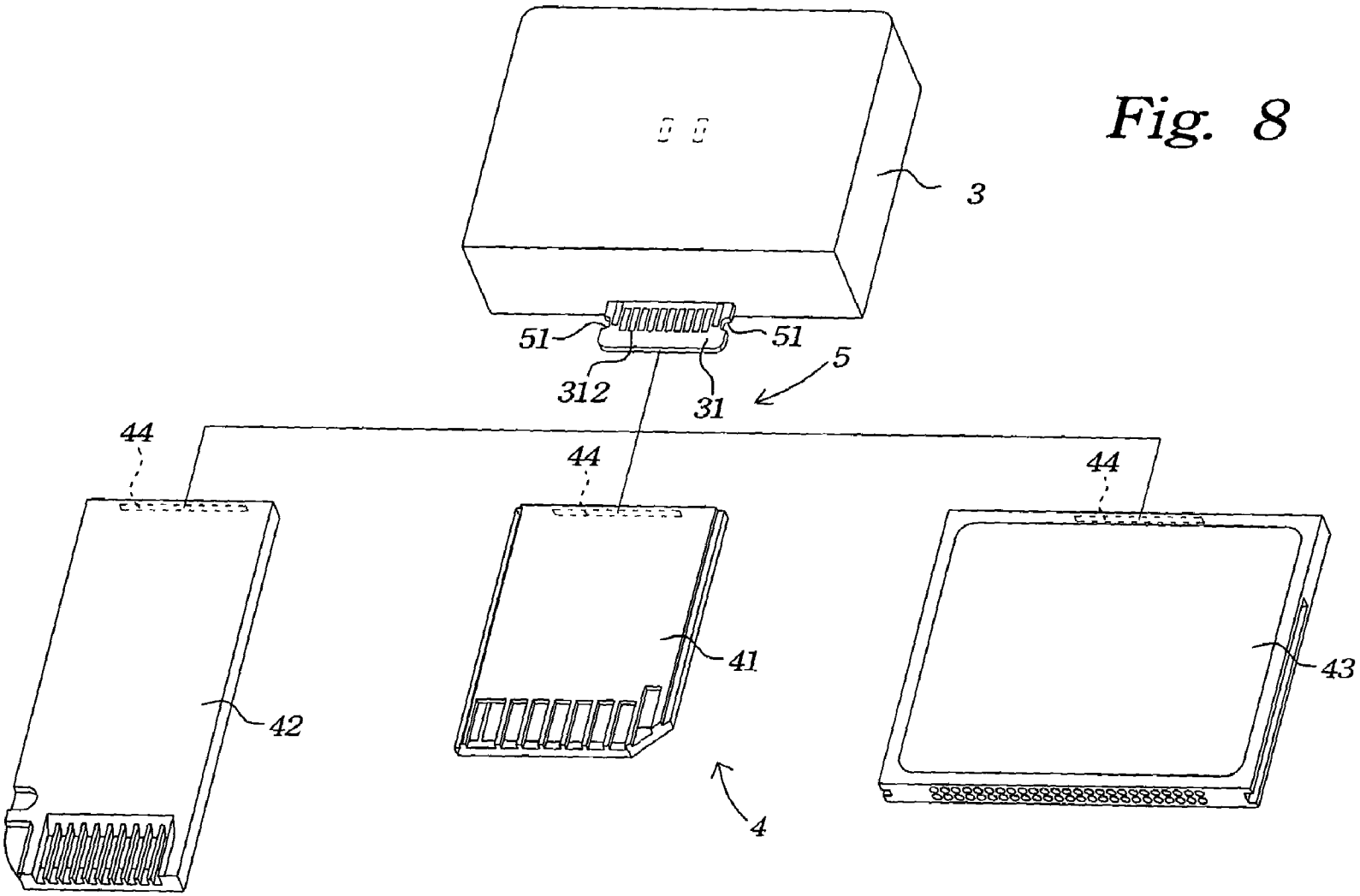
FIG. 8 is an exploded bottom perspective view of the apparatus with detachably connected memory-card plug adapter according to the present invention.

Please refer to FIGS. 7 and 8 that are exploded top and bottom perspective views, respectively, of an apparatus with detachably connected memory-card type adapter according to the present invention. As shown, the present invention mainly includes an apparatus 3, and a memory-card type adapter 4 selected for use with the apparatus 3.

The apparatus 3 is an electronic product such as a wireless network transmission apparatus, a digital camera, and the like. The apparatus 3 is provided at a predetermined position with an adapting plate 31, on at least one side surface of which, such as an upper surface thereof, there is provided with connecting lines 311.

The memory-card type adapter 4, as suggested by its name, is an adapter having a configuration of a memory card, and may include, for example, an SD-card type adapter 41, an MS-card type adapter 42, and a CF-card type adapter 43. As can be more clearly seen from FIG. 9 that illustrates an SD-card type adapter 41, the adapter 4 is provided at a front end with a socket 44, in which a plurality of elastic contact terminals 45 are provided corresponding to the connecting lines 311 on the adapting plate 31 of the apparatus 3. The memory-card type adapter 4 is detachably connected to the apparatus 3 by removably engaging the socket 44 with the adapting plate 31. When the adapter 4 is connected to the apparatus 3, the elastic contact terminals 45 in the socket 44 are simultaneously in contact with the connecting lines 311 on the adapting plate 31, so as to electrically connect the apparatus 3 and the adapter 4 to each other.

With the above arrangements, it is possible for the apparatus 3 to selectively use with any one of the above-mentioned memory-card type adapters 41, 42, 43. In the case the apparatus 3 is to connect to a notebook computer, the type or types of the memory-card socket or sockets (not shown) on the computer determine the type or types of the memory-card type adapter or adapters 4 that are to be selected for use with the apparatus 3. More specifically, if the notebook computer to which the apparatus 3 is to connect has, for example, an SD-card socket provided thereon, then the SD-card type adapter 41 matching the SD-card socket is selected for detachably connecting to the apparatus 3 via the adapting plate 31. When the apparatus 3 is to connect to another computer that provides a different type of memory-card socket, for example, an MS-card socket, a user needs only to disengage the old SD-card type adapter 41 from the adapting-plate 31 on the apparatus 3 and engage a separate MS-card type adapter 42 with the adapting plate 31, and the apparatus 3 may be plugged in the MS-card socket on the other computer via the MS-card type adapter 42. Similarly, a CF-card type adapter 43 or any other differently configured memory-card type adapter may be detachably engaged with the adapting plate 31 for the apparatus 3 to plug in a corresponding type of memory-card socket on any other computer. Therefore, the same one apparatus 3 is adapted to plug in different memory-card sockets on different computers via different memory-card type adapters 4. In this manner, a manufacturer need not prepare at high costs multiple sets of molds for producing the same type of apparatus having different memory-card plug adapters, and the user need not buy at high expenses multiple peripherals that are of the same type but respectively have different memory-card plug adapters. It is very economical and convenient for the user to buy only one type of apparatus that is adapted to plug in any type of memory-card socket on a computer simply by selecting and connecting to a memory-card type adapter 41, 42 or 43 that corresponds to the memory-card socket on the computer.

Please refer to FIGS. 7 and 8 at the same time. The adapting plate 31 on the apparatus 3 is laterally symmetrical in its configuration, and connecting lines 312 may be provided at an opposite side surface, such as a lower surface, of the adapting plate 31 completely corresponding to the connecting lines 311 on the upper surface of the adapting plate 31. That is, the connecting lines 312 and the connecting lines 311 are arranged at the lower and the upper surface of the adapting plate 31 in exactly the same sequence. Therefore, the memory-card type adapter 4 may be engaged with the apparatus 3 no matter the latter is positioned normally or upside down. This bi-directional engaging design enables the present invention to use indifferent spatial environments.

Figure 9:
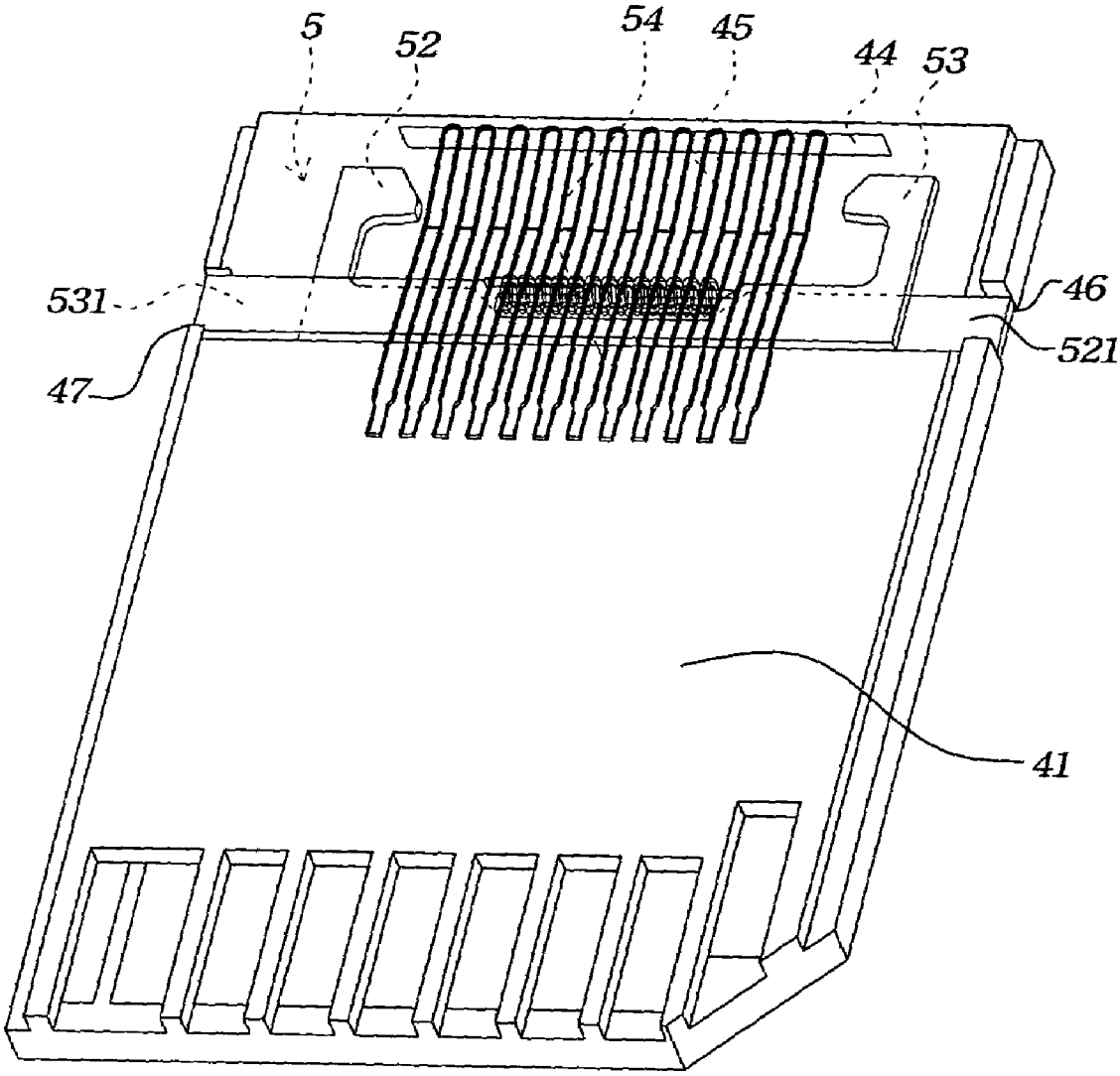
FIG. 9 schematically exemplifies the internal structure of the socket on the memory-card plug adapter used with the apparatus of the present invention.

Please refer to FIG. 9. To enable the adapting plate 31 of the apparatus 3 to firmly engage with and conveniently disengage from the socket 44 on the memory-card type adapter 4, there is provided a fixing means, such as a fastening means 5.

The fastening means 5 includes a pair of retaining notches 51 provided at two lateral ends of the adapting plate 31 on the apparatus 3, and a left and a right latch hook 52, 53 located in the memory-card adapter at two lateral sides of the socket 44. The left latch hook 52 includes a rear transverse arm portion 521 that extends rightward to project a free end from a right opening 46 provided on a right sidewall of the adapter 4; and the right latch hook 53 includes a rear transverse arm portion 531 that extends leftward to project a free end from a left opening 47 provided on a left sidewall of the adapter 4. A spring 54 is mounted between the two rear transverse arm portions 521 and 531.

The spring 54 normally pushes the two rear transverse arm portions 521 and 531 outward and thereby brings the left latch hook 52 and the right latch hook 53 to move toward each other and firmly engage with the two retaining notches 51 provided at two lateral ends of the adapting plate 31 inserted into the socket 44, so that the adapter 4 is firmly connected to the apparatus 3.

When it is desired to detach the memory-card type adapter 4 from the apparatus 3, the free ends of the two rear transverse arm portions 521 and 531 are inward pushed at the same time, so that the left and the right latch hook 52, 53 are moved away from one another to increase a distance between them. When the left and the right latch hook 52, 53 are sufficiently moved outward to finally disengage from the retaining notches 51 on the adapting plate 31, the apparatus 3 may be easily detached from the adapter 4. Therefore, the fastening means 5 allows the apparatus 4 to securely connect to and conveniently detach from the adapter 4.

What is claimed is:

1. An apparatus with detachably connected memory-card plug adapter, comprising:

a memory-card device, which is an electronic product, being provided at a predetermined position with an connector plate, said connector plate being provided on at least one surface with connecting lines; and a memory-card plug adapter being provided at a front end with a socket, said socket being internally provided with a plurality of elastic contact terminals corresponding to said connecting lines on said connector plate, and detachably engaged with said connector plate for said memory-card plug adapter to electrically and detachably connect to said apparatus;

whereby said memory-card device is adapted to plug in any type of memory-card socket provided on a computer through engagement of said connector plate on said memory-card device with one said memory-card plug adapter that corresponds to said memory-card socket on said computer.

2. The apparatus with detachably connected memory-card plug adapter as claimed in claim 1, wherein said connector plate has a laterally symmetrical configuration and is provided on upper and lower surfaces with said connecting lines, and said connecting lines on said upper surface of said connector plate are completely corresponding to said connecting lines on said lower surface of said connector plate.

3. The apparatus with detachably connected memory-card plug adapter as claimed in claim 1, further comprising fixing means for securing the engagement of said connector plate with said memory-card plug adapter.

4. The apparatus with detachably connected memory-card plug adapter as claimed in claim 3, wherein said fixing means include fastening means.

5. The apparatus with detachably connected memory-card plug adapter as claimed in claim 4, wherein said fastening means include a pair of retaining notches provided at two lateral ends of said connector plate, and a right and a left latch hook provided in said memory-card plug adapter at two lateral sides of said socket, and a spring mounted between said left and said right latch hook to normally bring said two latch hooks toward each other to elastically engage with said retaining notches on said connector plate.

6. The apparatus with detachably connected memory-card plug adapter as claimed in claim 5, wherein said left latch hook includes a rightward extended rear transverse arm portion that has a free end projected from a right opening provided at a right sidewall of said memory-card plug adapter, and said right latch hook includes a leftward extended rear transverse arm portion that has a free end projected from a left opening provided at a left sidewall of said memory-card plug adapter; and wherein said spring is mounted between said two rear transverse arm portions; said spring allowing inward pushing of said two rear transverse arm portions at their respective free ends and accordingly moving of said left and said right latch hook away from each other to finally disengage from two retaining notches provided at two lateral ends of said connector plate that is inserted into said socket.

7. An apparatus with detachably connected memory-card plug adapter, said memory-card plug adapter allowing said apparatus to plug in a corresponding memory-card socket provided on a computer, comprising: an electronic product being provided at a predetermined position with an connector plate, said connector plate having a laterally symmetrical configuration and being provided on said upper and lower surface with connecting lines, and said connecting lines being arranged on said upper and lower surface of said connector plate in exactly the same sequence.

* * * * *